US012038009B2

(12) United States Patent
Davidson

(10) Patent No.: US 12,038,009 B2
(45) Date of Patent: Jul. 16, 2024

(54) WATER-CONSERVING LIQUID RING VACUUM PUMP SYSTEM

(71) Applicant: John B. Davidson, Vicksburg, MS (US)

(72) Inventor: John B. Davidson, Vicksburg, MS (US)

( * ) Notice: Subject to any disclaimer, the term of this patent is extended or adjusted under 35 U.S.C. 154(b) by 143 days.

(21) Appl. No.: 17/944,058

(22) Filed: Sep. 13, 2022

(65) Prior Publication Data

US 2023/0003223 A1 Jan. 5, 2023

Related U.S. Application Data

(63) Continuation-in-part of application No. 17/716,574, filed on Apr. 8, 2022, now abandoned.

(60) Provisional application No. 63/147,681, filed on Feb. 9, 2021.

(51) Int. Cl.

| | |
|---|---|
| ***F04C 19/00*** | (2006.01) |
| ***F04D 17/16*** | (2006.01) |
| ***F04D 25/06*** | (2006.01) |
| ***F04D 27/00*** | (2006.01) |
| ***F04D 29/42*** | (2006.01) |
| ***F04D 29/44*** | (2006.01) |
| ***F04D 29/58*** | (2006.01) |

(52) U.S. Cl.
CPC ..... *F04D 17/168* (2013.01); *F04D 25/06* (2013.01); *F04D 27/008* (2013.01); *F04D 29/426* (2013.01); *F04D 29/445* (2013.01); *F04D 29/586* (2013.01)

(58) Field of Classification Search
CPC .... F04C 19/00; F04C 19/004; F28F 2009/226
See application file for complete search history.

(56) References Cited

U.S. PATENT DOCUMENTS 4,090,557 A * 5/1978 Currier ..... F28B 1/02 165/145
4,687,550 A * 8/1987 Wong ..... B01D 3/02 203/1

* cited by examiner

*Primary Examiner* — Philip E Stimpert
*Assistant Examiner* — Dnyanesh G Kasture
(74) *Attorney, Agent, or Firm* — Nath, Goldberg & Meyer; Joshua B. Goldberg

(57) ABSTRACT

The water-conserving liquid ring vacuum pump system receives the output from a water ring vacuum pump, removes the air and contaminants from the water, and returns the clean water to the make-up water port on the pump, thereby saving most of the water that would normally be discarded. Friction in the pump also heats the water, so the system is designed to cool the water as well.

20 Claims, 8 Drawing Sheets

WATER-CONSERVING LIQUID RING VACUUM PUMP SYSTEM

CROSS-REFERENCE TO RELATED APPLICATION

This application is a continuation-in-part of U.S. patent application Ser. No. 17/716,574, filed on Apr. 8, 2022, which claims the benefit of U.S. Provisional Patent Application No. 63/147,681, filed on Feb. 9, 2021.

BACKGROUND

1. Field

The disclosure of the present patent application relates to liquid ring vacuum pumps, and particularly to a water-conserving, liquid ring vacuum pump system.

2. Description of the Related Art

Liquid ring vacuum pumps have an impeller with blades attached to a center hub. The blades are located within a cylindrical body and are off-set from the center. The impeller is situated between two end plates, which have inlet and outlet ports. The pump requires a liquid sealant to create a vacuum. Prior to starting, the pump is partially filled with the liquid sealant. The liquid can be water, as in water ring pumps; an oil; or a solvent, depending upon the application. These water ring vacuum pumps are heavily used in the food industry and generally have a standard ¾" water hose from a municipal water supply hooked directly to the make-up water port of the pump. In addition to air, the output from the water ring vacuum pumps includes water, heavy contaminants (sediment), and light contaminants (foam). The water is replenished by adding water to a make-up water port on the pump. The water from the pump is commonly discharged onto the ground, or into a drain. Some municipalities require that the water be treated, before releasing it. In one example, a single 20 HP water ring vacuum pump uses 19 to 49 liters per minute, or 1,140 to 2,940 liters per hour. Many plants operate seven days a week and fifty-two weeks a year, so a single 20 HP water ring vacuum pump may use up to 25,683,840 liters of water per year. Multiply this use by the several thousand water ring vacuum pumps in service, and the amount of wasted water is staggering.

Thus, a water conserving, liquid ring vacuum pump system solving the aforementioned problems is desired.

SUMMARY

The water-conserving, liquid ring vacuum pump system receives the output from a water ring vacuum pump, removes the air and contaminants from the water to provide clean water, and returns the clean water to the make-up water port on the pump, thereby recirculating and saving most of the water that would normally be discarded. Friction in the pump also heats the water, so the system is designed to cool the water as well.

The system includes a dry compartment and a wet compartment. The dry compartment includes the electrical system components, a cooling air fan, and a cooling air distribution plenum, and houses the liquid ring vacuum pump. The wet compartment includes an open top, a left-side panel, a rear panel, a right-side panel, a front panel, and a bottom wall. Two chamber walls divide the wet compartment into three chambers. A first chamber receives water from a vacuum pump output stream after foam and air have been removed by a diffuser. A first chamber wall separates the upper portion of the first chamber from the second chamber and includes a gap to allow cold water at the lower portion of the first chamber to flow into the lower portion of the second chamber. A second chamber wall separates the lower portion of the second chamber from the lower portion of the third chamber, while allowing water to flow over the second chamber wail from the second chamber into the third chamber. The chambers form a sediment trap, such that sediment remains in the bottom of the first two chambers and cannot enter the third chamber.

The third chamber includes a thermostat extending through the front panel and a cold-water outlet connected to the water make-up port of the liquid ring vacuum pump via a solenoid valve. The thermostat opens when the water in the third chamber exceeds a predetermined limit. The third chamber also includes a float valve that opens when the level of water in the third chamber drops below a predetermined normal water level to supply cool water to the third chamber via a make-up water inlet. A water lower limit float switch opens when the water in the third chamber falls below a lower limit just above the cold-water outlet.

The cooling air system includes air-cooling tubes that extend through the third chamber. The cooling air fan has a central input for receiving cooling air from the air-cooling tubes and a fan shroud surrounding the fan for directing the cooling air to the plenum. The cooling air system further includes air-cooling tubes that extend through the first chamber and the second chamber and receive cooling air from the plenum.

The electrical system of the water-conserving, liquid ring vacuum pump system includes an AC-to-DC converter that produces a positive and a negative DC relay voltage from an AC voltage source, and also includes a first circuit breaker protecting the AC-to-DC converter. A second circuit breaker protects the vacuum pump motor, while a third circuit breaker protects the cooling air fan motor, and a fourth circuit breaker protects the solenoid of the solenoid valve. A main circuit relay connects the AC voltage source to the second, third and fourth circuit breakers. A control relay is controlled by an emergency stop switch, an on/off switch, the water lower limit float switch, and auxiliary contacts on the second, third and fourth circuit breakers. The control relay controls the main circuit relay to shut off power to the pump motor, fan motor, and solenoid should any of the circuit breakers trip, or if the water level drops below the lower limit, or if an operator depresses the emergency stop switch.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
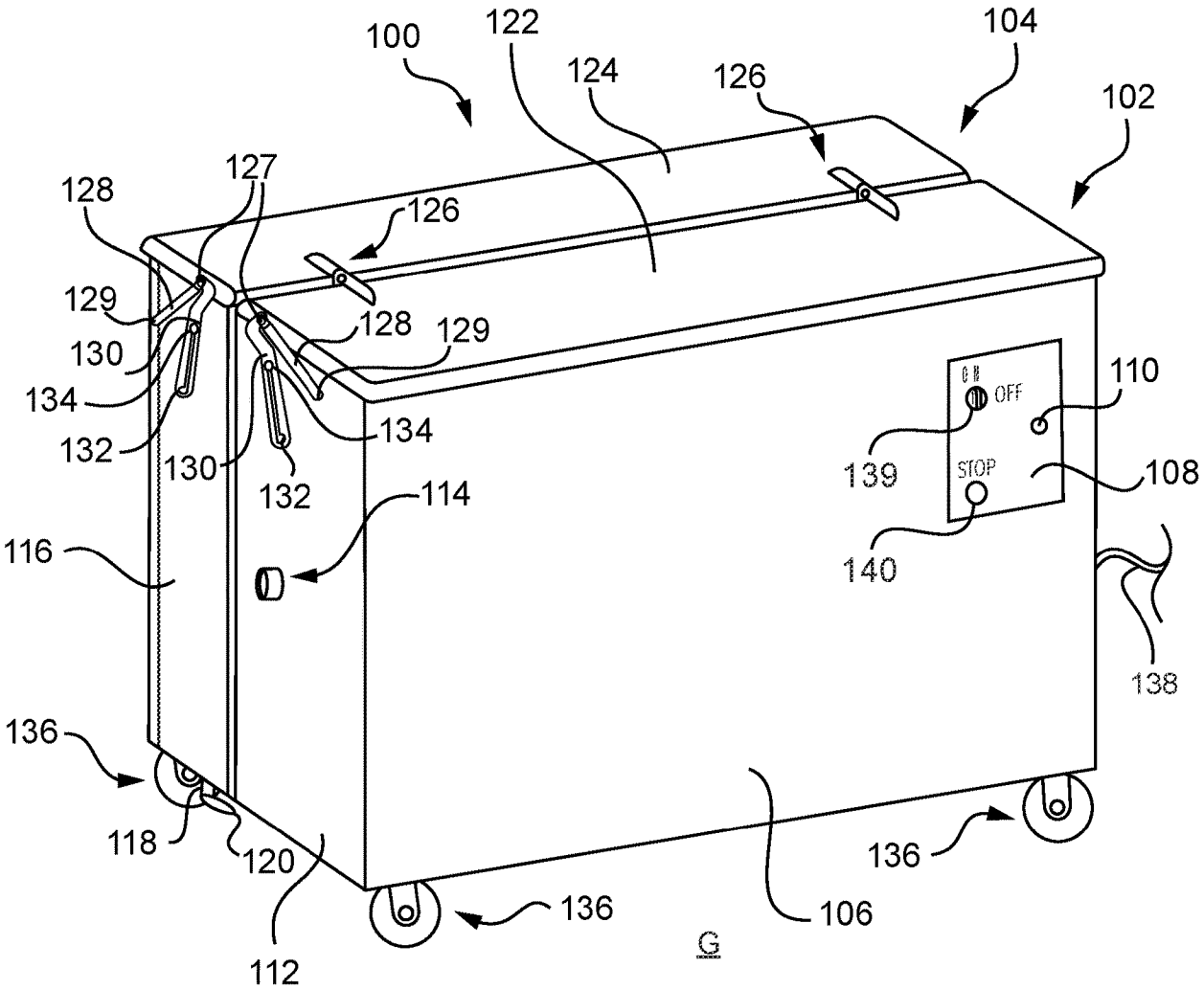
FIG. 1 is an environmental perspective view of a water-conserving vacuum pump system, showing the housing with its front panel, left side and top covers in their closed positions.
Figure 2:
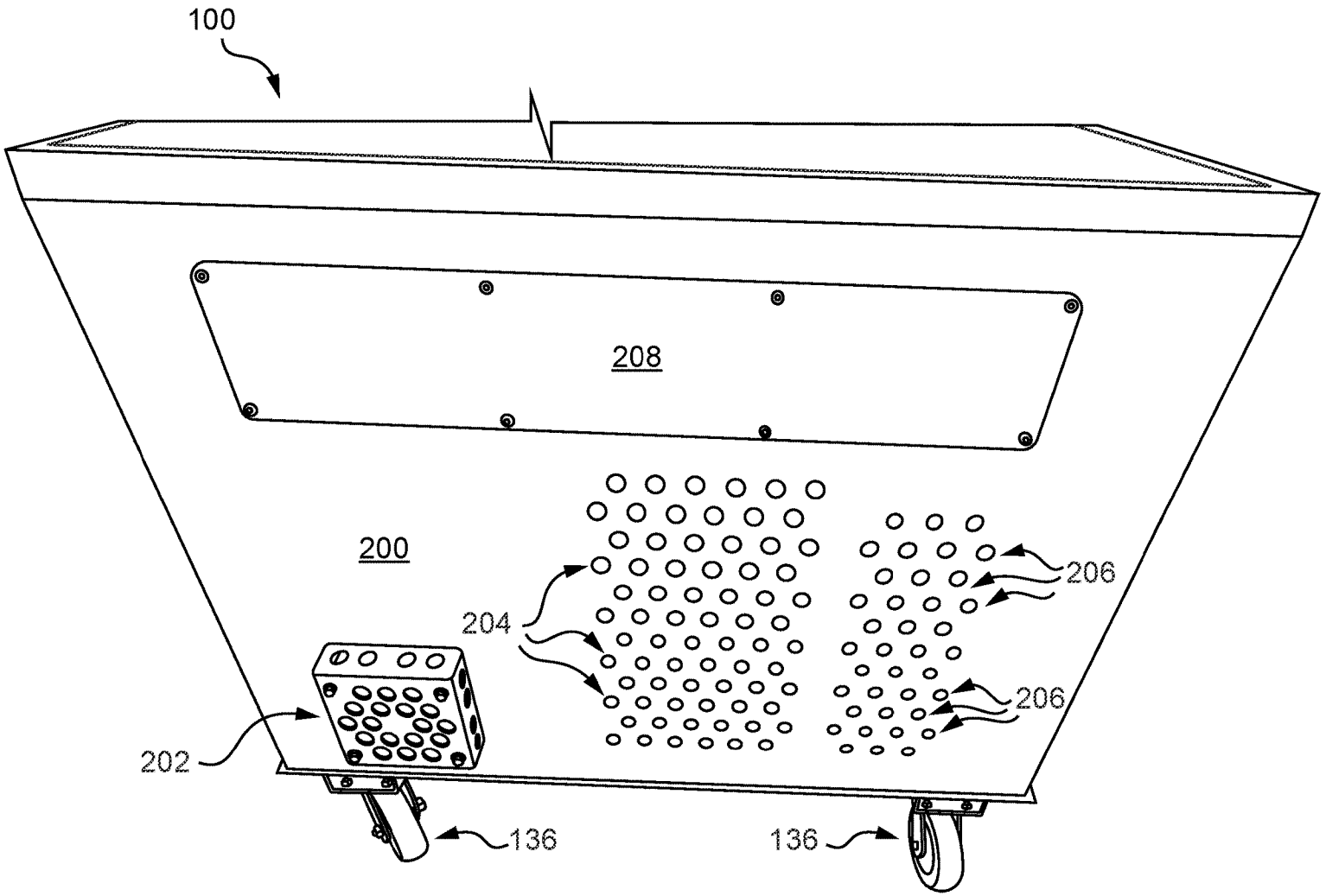
FIG. 2 perspective view of the water-conserving vacuum pump system of FIG. 1, showing its rear panel.
Figure 3:
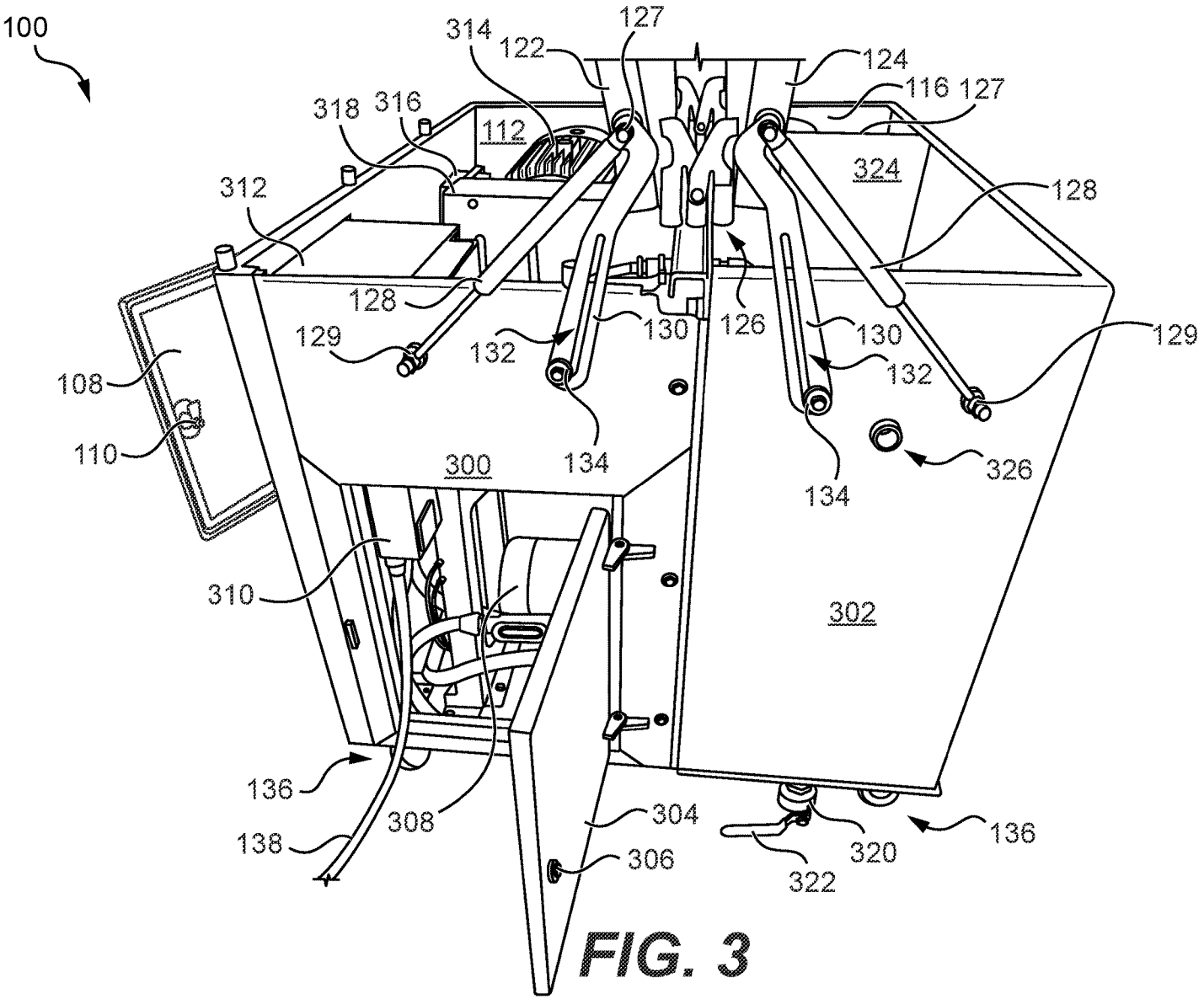
FIG. 3 is a perspective view of the water-conserving vacuum pump system of FIG. 1, showing its right side with open right access panel, its open front access panel, and its top covers in their open positions, showing some of the internal components of the system.

The external features of the water-conserving, liquid ring vacuum pump system 100 are shown in FIGS. 1-3. The water-conserving vacuum pump system 100 includes a dry compartment 102 and a wet compartment 104. The dry compartment 102 includes a front panel 106 having a hinged electrical box access panel 108. The electrical box access panel 108 may include a panel lock 110 to prevent access by unauthorized personal. An on/off switch 139 and an emergency stop button 140 are also mounted on the access panel 108. The dry compartment 102 further includes a left-side panel 112 and a right-side panel 300 (see FIG. 3) attached to and extending at right angles to the front panel 106. The left-side panel 112 includes a vacuum port 114 for connecting the pump to vacuum-operated equipment. The right-side panel 300 includes a fan motor access panel 304 for accessing various internal components of the dry compartment 102. The fan motor access panel 304 may include a panel lock 306, to prevent access by unauthorized personal. The dry compartment 102 has an open top that is closed by a dry compartment top cover 122.

The wet compartment 104 includes a rear panel 200 (see FIG. 2) with cooling air inputs 202 to a cooling air system, second chamber cooling air outputs 204 from the cooling air system, and first chamber cooling air outputs 206 from the cooling air system. The rear panel 200 may also include a panel 208 for indicia, such as logos or tradenames. The wet compartment 104 further includes a left-side panel 116 and a right-side panel 302 attached to and extending at right angles to the rear panel 200. A left-side water drain 118 extends through the bottom of the wet compartment 104 adjacent the left-side panel 116 and includes a left-side water drain valve operated by a left side water drain valve handle 120. A right-side water drain 320 extends through the bottom of the wet compartment 104 adjacent the right-side panel 302 and includes a right-side water drain valve operated by a right-side water drain valve handle 322. The right-side panel 302 includes a make-up water inlet 326. The wet compartment 104 has an open top that is dosed by a wet compartment top cover 124.

The covers 122, 124 are attached to a ridge between the compartments 102, 104 using hinges 126, so the covers 122, 124 can be rotated upward to access the interiors of the compartments 102, 104. As best seen in FIGS. 1 and 3, cover damping and locking mechanisms are attached between the side panels 112, 116, 300, 302 and connecting lugs 127 on the side flanges of the covers 122, 124. Each cover damping and locking mechanism includes a damping cylinder 128 with a distal end rotatably connected to the connecting lug 127 and a proximate end rotatably connected to a damping cylinder anchor 129 on the corresponding side panel 112, 116, 300, 302. A cover locking bar 130 is rotatably attached at its distal end to the connecting lug 127 and includes a J-shaped slot 132. A cover locking pin 134 extends through the J-shaped slot 132 and is attached to the corresponding side panel 112, 116, 300, 302. When the covers 122, 124 are raised to their highest level and released, the cover locking pin 134 enters the curved end of the J-shaped slot 132, thereby locking the covers 122, 124 in their raised position as shown in FIG. 3. Pressing upward slightly on the covers 122, 124 releases the cover locking pin 134 from the curved end of the J-shaped slot 132, allowing the covers 122, 124 to slowly close against the damping force of the damping cylinder 128. A plurality of casters 136 may be mounted on the bottom wall of the compartments 102, 104, to allow the water conserving, liquid ring vacuum pump system 100 to be rolled into position. Alternatively, the casters 136 may be replaced by legs if portability is not required. A power cord 138 is used to connect the system 100 to an appropriate electrical power source.

Figure 6:
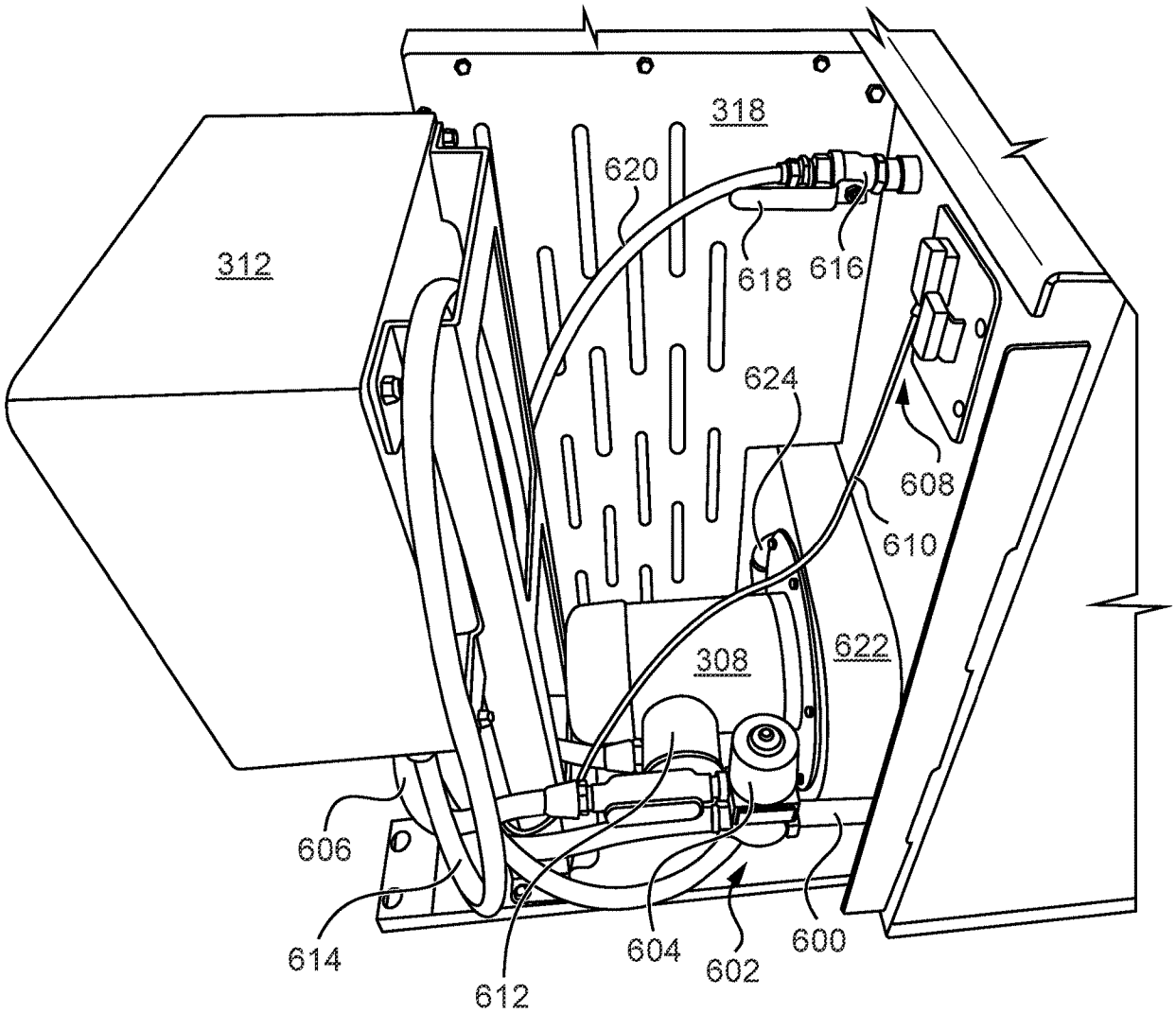
FIG. 6 is a perspective view of the water-conserving vacuum pump system of FIG. 1 as seen from the right side, with a portion of its outer housing removed to show internal components of the dry compartment of the system.

The interior components of the dry compartment 102 are shown in FIGS. 3 and 6. The dry compartment 102 houses further components of the cooling air system including a fan motor 308 that drives a centrifugal fan having a fan shroud 622 (see FIG. 6). The fan pulls air through cooling tubes and into a cooling air distribution plenum 318, as described in further detail with respect to the wet compartment 104. The power cord 138 extends into an electrical junction box 310 connected to the bottom of an electrical control box 312. The fan motor 308 includes an electrical junction box 612 and a fan motor wiring harness 614 that connects the fan motor 308 to electrical circuitry described below with respect to the electrical circuit diagram 800 of FIG. 8A vacuum pump motor 314 with an electrical junction box 316 drives a liquid ring vacuum pump (not shown).

Figure 4:
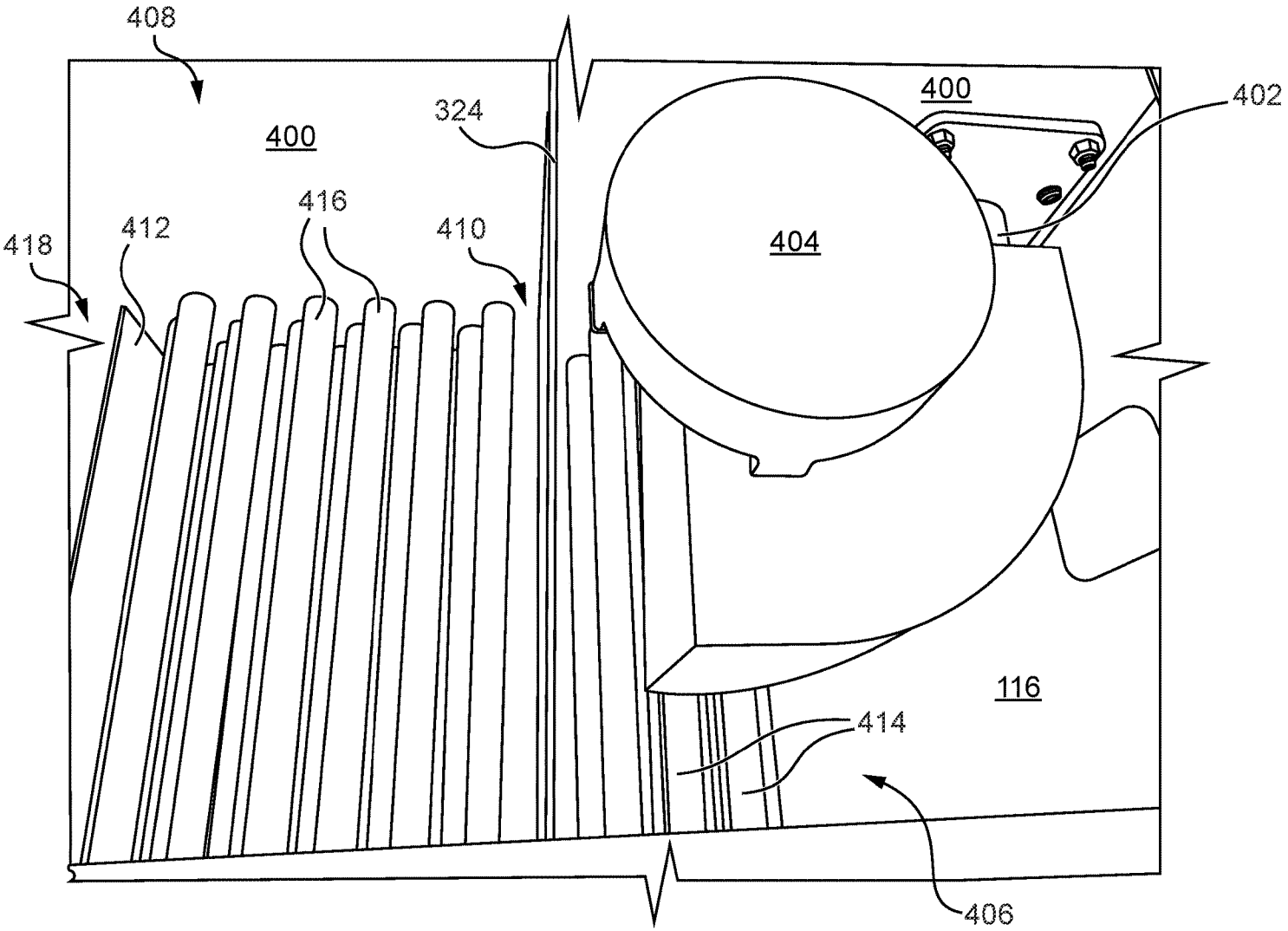
FIG. 4 is a perspective view of a first and second chamber of a wet compartment of the water-conserving vacuum pump system of FIG. 1, as seen from above.
Figure 5:
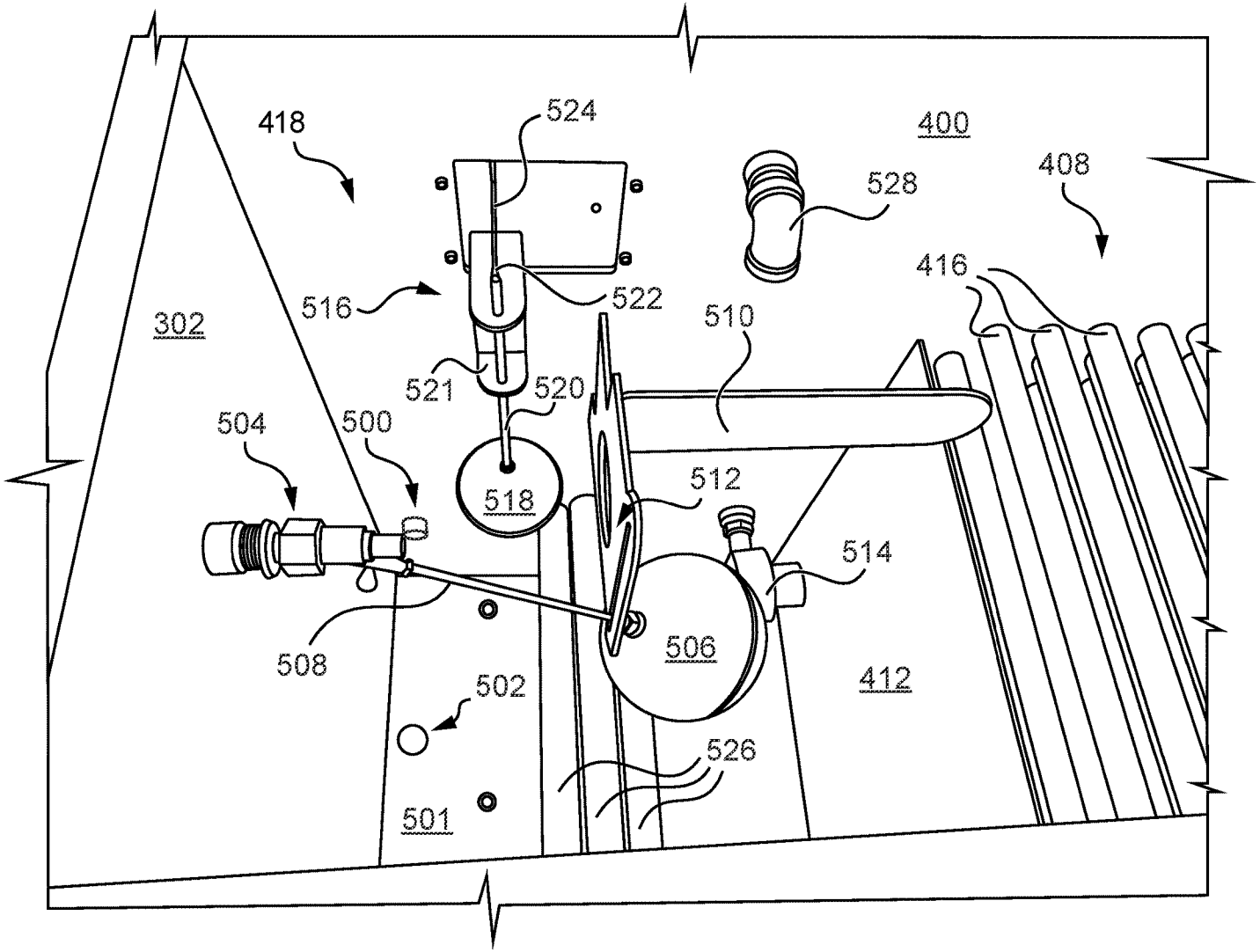
FIG. 5 is a perspective top view of a second and third chamber of the wet compartment of the water-serving vacuum pump system of FIG. 1, as seen from above.

The interior components of the wet compartment 104 are shown in FIGS. 3-5. The wet compartment 104 has a front panel 400 (see FIG. 4) that divides the dry compartment 102 from the wet compartment 104. As seen in FIG. 4, an air/water output pipe 402 from the vacuum pump extends through the front panel 400 and directs the output from the vacuum pump into a diffuser 404. The functioning of the diffuser 404 is described below with respect to FIG. 7. Water from the diffuser 404 enters a first chamber 406 of the wet compartment 104. The first chamber 406 includes a plurality of air-cooling tubes 414 that extend through the front panel 400 and receive cooling air from the plenum 318. The air in the air-cooling tubes 414 is vented out of the system 100 through the first chamber cooling air outputs 206 in the rear panel 200. A first chamber wall 324 extends between the front panel 400 and the rear panel 200 and divides the upper portion of the first chamber 406 from the upper portion of the second chamber 408. The first chamber wall 324 does not extend to the bottom wall 501 (see FIG. 5) of the wet compartment 104, thereby forming a gap 410 under chamber wall 324, to allow water from the lower portion of the first chamber 406 to flow into the lower portion of the second chamber 408. The second chamber 408 includes a plurality of air-cooling tubes 416 that extend through the front panel 400 and receive cooling air from the plenum 318. The air in the air-cooling tubes 416 is vented out of the system 100 through the second chamber cooling air outputs 204 in the rear panel 200. A second chamber wall 412 extends horizontally between the front panel 400 and the rear panel 200 and vertically from the bottom wall 501 of the wet compartment 104 to a point that is just below the normal water level WL in the wet compartment 104, as described in further detail below with respect to FIG. 7. The second chamber wall 412 divides the lower portion of second chamber 408 from the lower portion of a third chamber 418, with water flowing over the top of the second chamber wall 412 from the second chamber 408 to the third chamber 418.

The details of the third chamber 418 are shown in FIG. 5, while connections to the third chamber 418 are shown in FIG. 6. The third chamber 418 includes a cold water outlet 500 that is connected to the water make-up port (not shown) of the liquid ring vacuum pump via a cold water drainpipe 600. A solenoid valve 602 in the cold water drainpipe 600 includes a solenoid 604 that is connected to the control circuitry by a solenoid valve wiring harness 606. The solenoid valve 602 closes when power to the system 100 is turned off, as described further below, to stop water flow to the liquid ring vacuum pump that may damage the liquid ring vacuum pump upon start-up. The bottom wall 501 includes a drain 502 in both the third chamber 418 and the first chamber 406 (not shown). The drain 502 in the third chamber 418 leads to the right-side water drain 320, while the drain in the first chamber 406 leads to the left-side water drain 118. A float valve 504 receives input water (preferably cool water) via the make-up water inlet 326 through the right-side panel 302. A float 506 is connected to the float valve 504 by a float shaft 508, similar to float valves found in toilet tanks. A float guide bracket 510 includes a float guide slot 512 through which the float shaft extends to thereby stabilize the float. In addition, the float guide bracket 510 may include indicia indicating the correct water level, so that the float valve 504 can be easily adjusted. A third chamber thermostat 514 extends through the front panel 400 and opens when the temperature of the water in the third chamber 418 is above a preset third chamber temperature limit, similar to thermostats in water-cooled engines. Water from the third chamber thermostat 514 is directed downward by an elbow 624 for discharge or for connection to a drainpipe that leads to a drain in the facility in which the system 100 is located.

A lower water limit sensor assembly 516 is provided to shut down the system 100, should the water level fall to a lower water level limit close to the cold water outlet 500 of the liquid ring vacuum pump. The lower water limit sensor assembly 516 includes a float 518, and a float shaft 520 connected to the float 518. The float shaft 520 extends through a float shaft bracket 521 that includes a float shaft switch 522 that opens when the water level causes the float 518 and the shaft 520 to fall. Sensor wires 524 are routed to lower water limit sensor circuitry 608 in the dry compartment 102 that is connected to the control circuitry by a lower water limit sensor wiring harness 610. The third chamber 418 includes a plurality of air-cooling tubes 526 that extend through the third chamber 418 from the cooling air inputs 202 in the rear panel 200 through the front panel 400 and provide cooling air to the central input of the centrifugal fan within the fan shroud 622. An auxiliary input extends through the front panel 400 and includes an elbow 528 to direct fluids downward into the third chamber 418. The auxiliary input receives fluids via a supply tube 620 that may include a manual valve 616 with a valve handle 618 for controlling the flow of fluids out of the supply tube 620 and into the third chamber 418. While the auxiliary input is optional, some liquid ring vacuum pumps include a pressure relief port to avoid damage to the pump should the output become blocked. The supply tube 620 may be connected to the pressure relief port of the liquid ring vacuum pump to conserve any water lost due to an over pressure condition in the pump.

The initial steps to operate the water conserving, liquid ring vacuum pump system 100 is best described with respect to FIG. 1. The system 100 is designed to be very simple to operate in order to minimize training requirements of operating personnel. After connecting the vacuum port 114 to vacuum-operated equipment, connecting the power cord 138 to an appropriate electrical power source, and connecting the make-up water inlet 326 to a source of cool water, the operator turns the on/off switch 139 to the on position, as shown in FIG. 1. Thereafter, operation of the water-conserving, liquid ring vacuum pump system 100 is automatic, as described below with respect to FIGS. 7 and 8.

Figure 7:
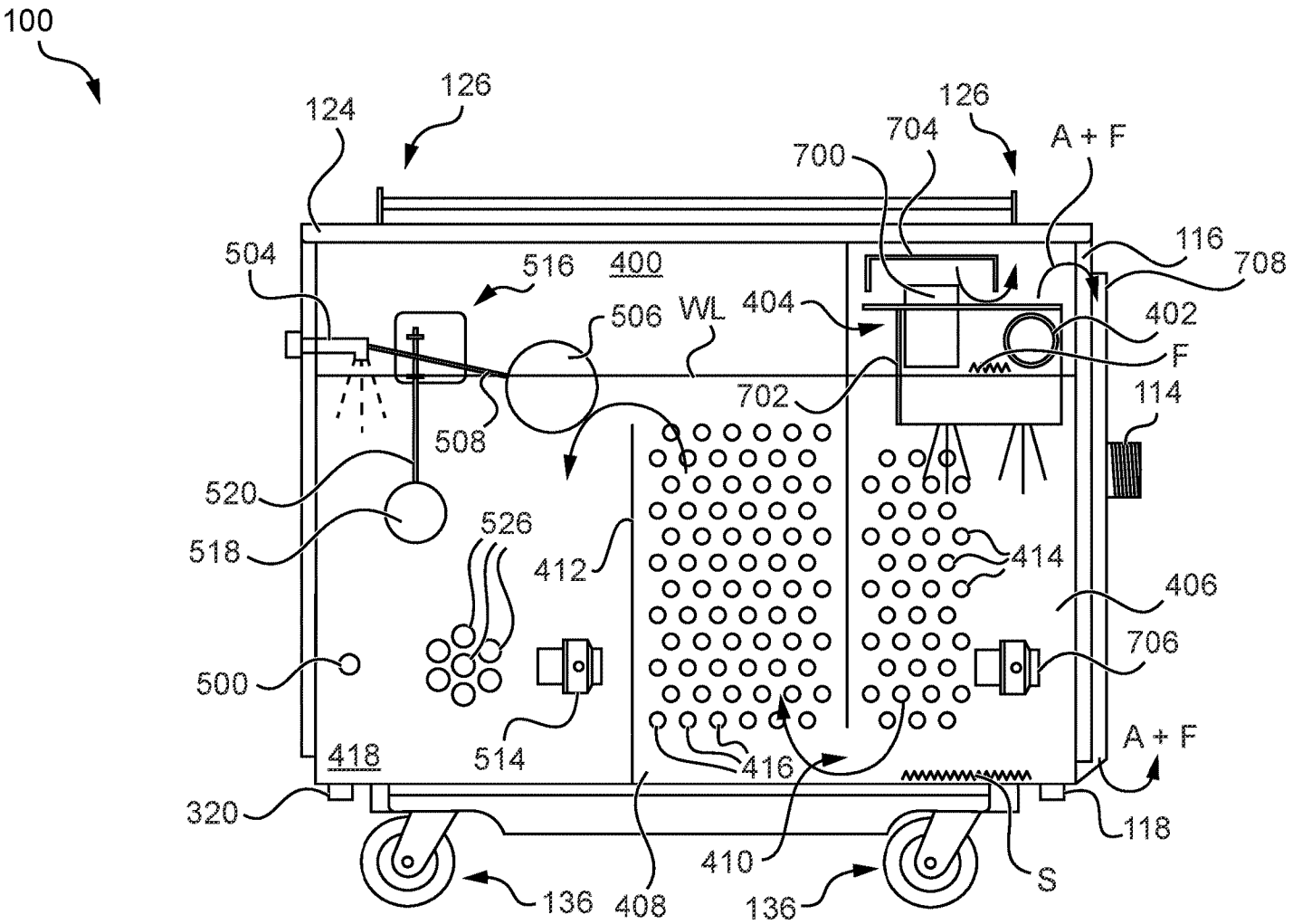
FIG. 7 is a schematic diagram of the wet compartment of the water-conserving vacuum pump system of FIG. 1, showing fluid flow through the wet compartment.

Turning to FIG. 7, when the vacuum pump starts operating, its output stream enters the diffuser 404 via the air/water output pipe 402. The output stream from the vacuum pump includes mostly air, together with some water, foam and sediment. The foam F floats on top of the water in the first chamber 406 and is held in the diffuser 404 by the sides of a diffuser shroud 702. The large volume of air from the vacuum pump blows the foam F off the top of the water and upward through a vertical air/foam extraction tube 700 that extends through the top of the diffuser shroud 702. The air and foam A+F is directed by an air/foam deflector 704 into a vertical duct 708 that extends down the left-side panel 116 and is exhausted near the bottom of the left-side panel 116, or may be directed to air filtering or conditioning equipment before the air is released to the atmosphere. While some of the foam F may be blown outside of the air/foam deflector 704, it floats on top of the water in the first chamber 406 and is held in the first chamber 406 by the first chamber wall 324. The water from the diffuser 404 sinks in the first chamber 406 and is cooled by the air flowing through the plurality of air-cooling tubes 414. A first chamber thermostat 706 extends through the front panel 400 and opens when the temperature of the water in the first chamber 406 is above a preset first chamber temperature limit, similar to thermostats in water-cooled engines. As with the third chamber thermostat 514, water from the first chamber thermostat 706 is directed downward by an elbow for discharge or connection to a drainpipe that leads to a drain in the facility in which the system 100 is located.

The water exits the first chamber 406 through the gap 410 under first chamber wall 324 and enters the second chamber 408. The water then rises in the second chamber 408 and is cooled by the air flowing through the plurality of air-cooling tubes 416. Once the water in the second chamber 408 rises to the top of the second chamber wall 412 it enters the third chamber 418 and mixes with the water already in the third chamber 418. The configuration of the first chamber 406, the second chamber 408 and the water flow under the chamber wall 324 and over the second chamber wall 412 produces a sediment trap, wherein heavier sediment S collects on the bottom of the first chamber 406, and to a more limited extent on the bottom of the second chamber 408.

As the water sinks in the third chamber 418 it is cooled by the air flowing through the plurality of air-cooling tubes 526 before exiting through the cold-water outlet 500 to the water make-up port of the liquid ring vacuum pump. As the thermostats 514, 706 drain warm water from their corresponding chamber 418, 406, respectively, the water level WL in the chambers 406, 408, 418 drops. As the water level drops below the preset normal water level WL, as shown in FIG. 7, the float 506 also drops, thereby opening the float valve 504 and allowing cool water to enter the third chamber 418 via the lake-up water inlet 326. The interaction between the float valve 504 and the thermostats 514, 706 maintains the water exiting through the cold-water outlet 500 at a cold temperature to protect the vacuum pump from high temperatures.

Figure 8:
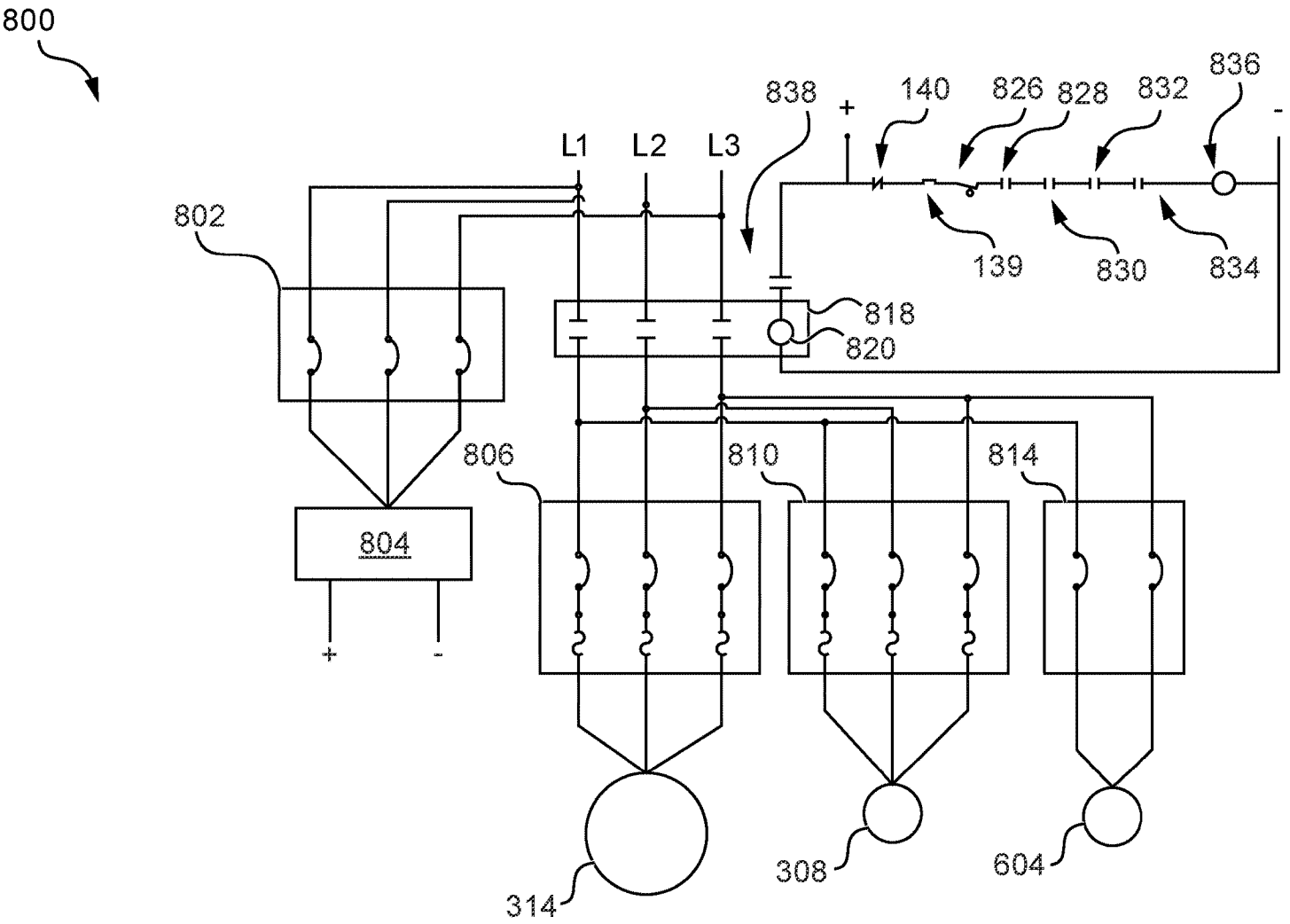
FIG. 8 is a schematic electrical circuit diagram of the water-conserving vacuum pump system of FIG. 1.

The electrical system of the water conserving vacuum pump system 100 is shown in the system wiring diagram 800 of FIG. 8. The system includes a first circuit breaker 802 that protects an AC-to-DC converter 804 that produces a DC relay voltage, which may be any suitable DC voltage, for example 24 VDC. The first circuit breaker 802 is directly connected to a three phase (L1, L2, L3) power source and includes an auxiliary contact 828 that is wired into the DC circuit. A second circuit breaker 806 protects the vacuum pump motor 314 and includes both quick-blow and slow-blow breakers, as well as an auxiliary contact 830 that is wired into the DC circuit. A soft start for the pump motor 314 may also be included in the second circuit breaker 806. A third circuit breaker 810 protects the fan motor 308 and includes both quick-blow and slow-blow breakers, as well as an auxiliary contact 832 that is wired into the DC circuit. A fourth circuit breaker 814 protects the solenoid 604 of the solenoid valve 602 and includes an auxiliary contact 834 that is wired into the DC circuit. The second circuit breaker 806, the third circuit breaker 810, and the fourth circuit breaker 814 are connected to the three-phase (L1, L2, L3) power source via a main circuit relay 818 when its relay coil 820 is energized. The emergency stop switch 140, the on/off switch 139, the low water float switch 826, and the auxiliary contacts 828, 830, 832, 834 are all wired in series with a control relay coil 836 between the positive and negative DC voltages. The relay coil 820 of the main circuit relay 818 is directly connected to the negative DC voltage and connected to the positive DC voltage through the control relay contact 838.

If none of the circuit breakers 802, 806, 810, 814 are tripped, then all of their auxiliary contacts 828, 830, 832, 834 will be closed. If there is an adequate water level in the third chamber 418, the low water float switch 826 will be closed as well. The low water float switch 826 may be a simple switch, as shown in FIG. 5, such as the float shaft switch 522, or may be a relay contact in the lower water limit sensor circuitry 608 in FIG. 6. If the emergency stop switch 140 is also not tripped, then by turning the on/off switch 824 to the "on" position, the on/off switch 824 is closed, completing the circuit to the control relay coil 836, thereby energizing the control relay and closing its contact 838. When this contact 838 closes, the relay coil 820 of the main circuit relay 818 is energized and its contacts are closed, providing power to the vacuum pump motor 314, the fan motor 308, and the solenoid 604 of the solenoid valve 602, thereby opening the solenoid valve 602 and initiating air and water flow through the system 100. Should any of the circuit breakers 802, 806, 810, 814 trip, then the power to the vacuum pump motor 314, the fan motor 308, and the solenoid 604 of the solenoid valve 602 are shut off, thereby protecting all the components in the system 100. In addition, should the solenoid valve 602 remain open after power is removed from its solenoid 604, the soft start for the pump motor 314, will start the pump motor 314 slowly to avoid damage to the vanes of the vacuum pump from the water that entered the vacuum pump through the broken solenoid valve while the system is de-energized.

The water-conserving liquid ring vacuum pump system 100 includes simple setup and operation, as described above. In addition, the system requires very little maintenance, as no filters are employed. Once the system 100 is turned off, the wet compartment 104 is easily cleaned by opening the drain 118 in the bottom wall of the first chamber 406 to drain the first chamber 406 and the second chamber 408, and opening the drain 320 in the bottom wall of the third chamber 418 to drain the third chamber 418. The wet compartment top cover 124 may also be opened to allow flushing the sediment S and any other debris out of the chambers 406, 408, 418 and through the drains 118, 320. It should also be noted that the wet compartment top cover 124 may also be opened during operation of the system 100, and the drain 118 may also be opened during operation of the system 100 to allow flushing the sediment S and any other debris out of the chambers 406, 408. Any water that needs to be made up is supplied by the float valve 504 when the water level WL in the third chamber 418 falls below the normal water level. In addition to the ease of keeping the system 100 clean, the vast majority of external components and the internal components of the wet compartment 104 can be made of stainless steel that can be sanitized using chemicals and then easily rinsed as described above. This makes the water-conserving liquid ring vacuum pump system 100, particularly attractive for use in the food industry.

The system 100 can be used with any brand or type of water ring vacuum pump. It may also be sized to operate with different size pumps, such as 5 hp, 7.5 hp, 10 hp, 15 hp, 20 hp, 25 hp and larger. While the configuration of the system 100 remains basically the same, larger pumps require larger size systems to handle the increased water handling requirements.

It is to be understood that the water-conserving, liquid ring vacuum pump system is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A water-conserving liquid ring vacuum pump system, comprising a liquid ring vacuum pump having a process inlet, a process output for a vacuum pump output stream, and a water make-up port for supplying water to a liquid ring of the liquid ring vacuum pump, a wet compartment having an open top, a left-side panel, a rear panel, a right-side panel, a front panel and a bottom wall, the wet compartment further including:

a first chamber having an upper portion and a lower portion, the first chamber receiving water from the vacuum pump output stream;

a second chamber having an upper portion and a lower portion;

a first chamber wall extending between the front panel and the rear panel and separating the upper portion of the first chamber from the upper portion of the second chamber, the first chamber wall ending above the bottom wall of the wet compartment, thereby forming a gap under the first chamber wall to allow water from the lower portion of the first chamber to flow into the lower portion of the second chamber;

a third chamber having a lower portion, a third chamber thermostat extending through the front panel, the third chamber thermostat opening when the temperature of water in the third chamber reaches a preset third chamber temperature limit to drain water from the third chamber through the front panel, the third chamber further having cold water outlet connected to the water make-up port of the liquid ring vacuum pump, the third chamber further having an upper portion and a float valve having a float and a float shaft connecting the float to the float valve, the float valve being adapted for connection to a source of cool water via a make-up water inlet, the float valve opens when the level of water in the wet compartment falls below a preset normal water level, allowing cool water to enter the third chamber via the make-up water inlet; and a second chamber wall extending horizontally between the front panel and the rear panel and vertically from the bottom wall of the wet compartment to a point just below a normal water level in the wet compartment, water from the second chamber flowing over the second chamber wall into the third chamber.

2. The water-conserving liquid ring vacuum pump system as recited in claim 1, further comprising a dry compartment and a cooling air system, the cooling air system including:

a first plurality of air-cooling tubes extending through the third chamber, a centrifugal fan in the dry compartment, the centrifugal fan having a fan motor and having a central input for receiving cooling air from the first plurality of air-cooling tubes;

a fan shroud in the dry compartment, the fan shroud surrounding the fan for directing the cooling air from the centrifugal fan;

a plenum in the dry compartment, the plenum being connected to the shroud for receiving and distributing the cooling air;

a second plurality of air-cooling tubes extending through the second chamber and receiving the cooling air from the plenum; and a third plurality of air-cooling tubes that extending through the first chamber and receiving the cooling air from the plenum.

3. The water-conserving liquid ring vacuum pump system as recited in claim 2, wherein the rear panel includes:

cooling air inputs therethrough, the first plurality of air-cooling tubes receiving the cooling air from the cooling air inputs;

second chamber cooling air outputs, the second chamber cooling air outputs venting the cooling air from the second plurality of air-cooling tubes; and first chamber cooling air outputs, the first chamber cooling air outputs venting the cooling air from the third plurality of air-cooling tubes.

4. The water-conserving liquid ring vacuum pump system as recited in claim 2, further comprising an electrical system, the electrical system including:

an AC-to-DC converter producing a positive and a negative DC relay voltage from an AC voltage source;

a first circuit breaker connected between the AC voltage source and the AC-to-DC converter, the first circuit breaker including a first auxiliary contact;

a main circuit relay having a relay coil, and contacts connected to the AC voltage source;

a second circuit breaker connected between the main circuit relay contacts and adapted for connection to a vacuum pump motor, the second circuit breaker including quick-blow breakers, slow-blow breakers, and a second auxiliary contact;

a third circuit breaker connected between the main circuit relay contacts and the fan motor, the third circuit breaker including quick-blow breakers, slow-blow breakers, and a third auxiliary contact:

an emergency stop switch;

an on/off switch; and a control relay having a control relay coil and a control relay contact, the first auxiliary contact, the second auxiliary contact, the third auxiliary contact, the emergency stop switch, and the on/off switch all being wired in series with the control relay coil between the positive and negative DC voltages, the relay coil of the main circuit relay being directly connected to the negative DC voltage and connected to the positive DC voltage through the control relay contact.

5. The water-conserving liquid ring vacuum pump system as recited in claim 4, further comprising:

a solenoid valve having a solenoid connected thereto, the solenoid valve connecting the cold water outlet to the water make-up port of the liquid ring vacuum pump when the solenoid is energized; and a fourth circuit breaker connected between the main circuit relay contacts and the solenoid of the solenoid valve, the fourth circuit breaker including a fourth auxiliary contact, the first auxiliary contact, the second auxiliary contact, the third auxiliary contact, the fourth auxiliary contact, the emergency stop switch, and the on/off switch all being wired in series with the control relay coil between the positive and negative DC voltages.

6. The water-conserving liquid ring vacuum pump system as recited in claim 5, further comprising a lower water limit sensor assembly in the third chamber, the lower water limit sensor assembly including:

a float shaft bracket;

a float;

a float shaft connected to the float and extending through the float shaft bracket; and a low water float switch, the low water float switch opening when the water level in the third chamber falls below a lower water level limit, and the low water float switch, the first auxiliary contact, the second auxiliary contact, the third auxiliary contact, the fourth auxiliary contact, the emergency stop switch, and the on/off switch all being wired in series with the control relay coil between the positive and negative DC voltages.

7. The water-conserving liquid ring vacuum pump system as recited in claim 1, further comprising a diffuser, the diffuser directing water from the vacuum pump output stream into the first chamber, while directing air and any foam from the vacuum pump output stream out of the water conserving liquid ring vacuum pump system.

8. The water-conserving liquid ring vacuum pump system as recited in claim 7, wherein the diffuser comprises:

a diffuser shroud with sides and a top, the sides of the diffuser shroud maintaining any foam from the vacuum pump output stream within the shroud on the top of water within the diffuser shroud; and a vertical air/foam extraction tube;

wherein air from the vacuum pump output stream blows any foam off the top of the water and upward through the vertical air/foam extraction tube.

9. The water-conserving liquid ring vacuum pump system as recited in claim 8, further comprising a vertical duct extending down the left-side panel of the wet compartment, wherein:

the diffuser further includes an air/foam deflector; and the air and any foam from the vertical air/foam extraction tube is directed by the air/foam deflector into the vertical duct.

10. The water-conserving liquid ring vacuum pump system as recited in claim 1, further comprising a first chamber thermostat in the lower portion of the first chamber, the first chamber thermostat extending through the front panel and opening when the temperature of the water in the first chamber is above a preset first chamber temperature limit.

11. The water-conserving, liquid ring vacuum pump system as recited in claim 1, further comprising a first drain in the bottom wall in the first chamber, the first drain having a first manual drain valve, the first chamber and the second chamber being drained when the first manual drain valve is opened.

12. The water-conserving liquid ring vacuum pump system as recited in claim 11, further comprising a second drain in the bottom wall in the third chamber, the second drain having a second manual drain valve, the third chamber being drained when the second manual drain valve is opened.

13. The water-conserving liquid ring vacuum pump system as recited in claim 1, further comprising a float guide bracket in the third chamber, the float guide bracket including a float guide slot through which the float shaft extends in order to stabilize the float.

14. The water-conserving, liquid ring vacuum pump system as recited in claim 1, further comprising:

a dry compartment with an open top;

a dry compartment top cover for covering the open top of the dry compartment;

a wet compartment top cover for covering the open top of the wet compartment; and hinges attaching the dry compartment top cover and the wet compartment top cover to a ridge between the dry compartment and the wet compartment.

15. The water-conserving liquid ring vacuum pump system as recited in claim 14, further comprising:

a first cover damping and locking mechanism attached between a left-side panel of the dry compartment and a left side flange of the dry compartment top cover;

a second cover damping and locking mechanism attached between the left-side panel of the wet compartment and a left side flange of the wet compartment top cover;

a third cover damping and locking mechanism attached between a right-side panel of the dry compartment and a right-side flange of the dry compartment top cover, a fourth cover damping and locking mechanism attached between the right-side panel of the wet compartment and a right-side flange of the wet compartment top cover.

16. The water-conserving liquid ring vacuum pump system as recited in claim 15, wherein:

the first cover damping and locking mechanism comprises:

a first connecting lug attached to the left side flange of the dry compartment top cover;

a first damping cylinder anchor attached to the left-side panel of the dry compartment; and a first damping cylinder having a distal end rotatably connected to the first connecting lug and a proximate end rotatably connected to the first damping cylinder anchor, the second cover damping and locking mechanism comprises:

a second connecting lug attached to the left side flange of the wet compartment top cover;

a second damping cylinder anchor attached to the left-side panel of the wet compartment; and a second damping cylinder having a distal end rotatably connected to the second connecting lug and a proximate end rotatably connected to the second damping cylinder anchor, the third cover damping and locking mechanism comprises:

a third connecting lug attached to the right-side flange of the dry compartment top cover;

a third damping cylinder anchor attached to the right-side panel of the dry compartment; and a third damping cylinder having a distal end rotatably connected to the third connecting lug and a proximate end rotatably connected to the third damping cylinder anchor, and the fourth cover damping and locking mechanism comprises:

a fourth connecting lug attached to the right-side flange of the wet compartment top cover;

a fourth damping cylinder anchor attached to the right-side panel of the wet compartment; and a fourth damping cylinder having a distal end rotatably connected to the fourth connecting lug and a proximate end rotatably connected to the fourth damping cylinder anchor.

17. The water-conserving liquid ring vacuum pump system as recited in claim 16, wherein:

the first cover damping and locking mechanism further comprises:

a first cover locking bar rotatably attached at its distal end to the first connecting lug, the first cover locking bar including a first J-shaped slot defined therein, the first J-shaped slot defining a first curved end; and a first cover locking pin extending through the first J-shaped slot and attached to the left-side panel of the dry compartment;

the second cover damping and locking mechanism further comprises:

a second cover locking bar rotatably attached at its distal end to the second connecting lug, the second cover locking bar including a second J-shaped slot defined therein, the second J-shaped slot defining a second curved end; and a second cover locking pin extending through the second J-shaped slot and attached to the left-side panel of the wet compartment;

the third cover damping and locking mechanism further comprises:

a third cover locking bar rotatably attached at its distal end to the third connecting lug the third cover locking bar including a third J-shaped slot defined therein, the third J-shaped slot defining a third curved end; and a third cover locking pin extending through the third J-shaped slot and attached to the right-side panel of the dry compartment; and the fourth cover damping and locking mechanism further comprises a fourth cover locking bar rotatably attached at its distal end to the fourth connecting lug, the fourth cover locking bar including a fourth J-shaped slot defined therein, the fourth J-shaped slot defining a fourth curved end; and a fourth cover locking pin extending through the fourth J-shaped slot and attached to the right-side panel of the wet compartment.

18. The water-conserving liquid ring vacuum pump system as recited in claim 1, further comprising:

a dry compartment having a bottom; and two casters mounted on the bottom of the dry compartment;

two casters mounted on the bottom wall of the wet compartment.

19. A water-conserving liquid ring vacuum pump system, comprising: a liquid ring vacuum pump having a process inlet, a process output for a vacuum pump output stream, and a water make-up port for supplying water to a liquid ring of the liquid ring vacuum pump, a wet compartment having an open top, a left-side panel, a rear panel, a right-side panel, a front panel and a bottom wall, the wet compartment further including:

a first chamber including an upper portion and a lower portion, the first chamber receiving water from the vacuum pump output stream;

a second chamber including an upper portion and a lower portion:

a first chamber wall extending between the front panel and the rear panel, the first chamber wall separating the upper portion of the first chamber from the upper portion of the second chamber, the first chamber wall ending above the bottom wall of the wet compartment, thereby forming a gap under the first chamber wall to allow water from the lower portion of the first chamber to flow into the lower portion of the second chamber, a third chamber having a lower portion, a third chamber thermostat extending through the front panel, and a cold-water outlet connected to the water make-up port of the liquid ring vacuum pump, the third chamber having an upper portion and a float valve having a float and a float shaft connecting the float to the float valve, the float valve being adapted for connection to a source of cool water via a make-up water inlet, the float valve opening when the level of water in the wet compartment falls below a preset normal water level to allow cool water to enter the third chamber via the make-up water inlet, the third chamber thermostat opening when the temperature of water in the third chamber reaches a preset third chamber temperature limit to drain water from the third chamber through the front panel;

a second chamber wall extending horizontally between the front panel and the rear panel and extending vertically from the bottom wall of the wet compartment to just below a normal water level in the wet compartment, water from the second chamber flowing over the second chamber wall into the third chamber;

a dry compartment;

a cooling air system, the cooling air system including:

a first plurality of air-cooling tubes extending through the third chamber;

a centrifugal fan in the dry compartment, the centrifugal fan having a fan motor and having a central input receiving cooling air from the first plurality of air-cooling tubes;

a fan shroud in the dry compartment, the fan shroud surrounding the fan for directing the cooling air from the centrifugal fan;

a plenum in the dry compartment, the plenum being connected to the shroud for receiving and distributing the cooling air;

a second plurality of air-cooling tubes extending through the second chamber and receiving the cooling air from the plenum; and a third plurality of air-cooling tubes extending through the first chamber and receiving the cooling air from the plenum; and an electrical system, the electrical system including:

an AC-to-DC converter adapted for producing a positive and a negative DC relay voltage from an AC voltage source;

a first circuit breaker connected between the AC voltage source and the AC-to-DC converter, the first circuit breaker including a first auxiliary contact:

a main circuit relay having a relay coil and contacts adapted for connection to the AC voltage source;

a second circuit breaker connected between the main circuit relay contacts and adapted for connection to a vacuum pump motor, the second circuit breaker including quick-blow breakers, slow-blow breakers, and a second auxiliary contact;

a third circuit breaker connected between the main circuit relay contacts and the fan motor, the third circuit breaker including quick-blow breakers, slow-blow breakers, and a third auxiliary contact;

an emergency stop switch;

an on/off switch; and a control relay having a control relay coil and a control relay contact; wherein the first auxiliary contact, the second auxiliary contact, the third auxiliary contact, the emergency stop switch, and the on/off switch are wired in series with the control relay coil between the positive and negative DC voltages, and wherein the relay coil of the main circuit relay is directly connected to the negative DC voltage and connected to the positive DC voltage through the control relay contact.

20. The water-conserving, liquid ring vacuum pump system as recited in claim 19, further comprising:

a solenoid valve having a solenoid, the solenoid valve being adapted for connecting the cold-water outlet to the water make-up port of the liquid ring vacuum pump when the solenoid is energized;

a fourth circuit breaker connected between the main circuit relay contacts and the solenoid of the solenoid valve, the fourth circuit breaker including a fourth auxiliary contact, the first auxiliary contact, the second auxiliary contact, the third auxiliary contact, the fourth auxiliary contact, the emergency stop switch, and the on/off switch being wired in series with the control relay coil between the positive and negative DC voltages.

* * * * *